US007500532B2

(12) United States Patent
Koga et al.

(10) Patent No.: US 7,500,532 B2
(45) Date of Patent: Mar. 10, 2009

(54) SWIVELING WORK MACHINE

(75) Inventors: Kenzo Koga, Izumi (JP); Shizuo Shimoie, Sakai (JP); Yoshihiro Kato, Wakayama (JP); Fumiki Sato, Sakai (JP); Takanori Matsumoto, Sakai (JP); Naoki Miyata, Kawachinagano (JP)

(73) Assignee: Kubota Corporation, Osaka (JP)

( * ) Notice: Subject to any disclaimer, the term of this patent is extended or adjusted under 35 U.S.C. 154(b) by 448 days.

(21) Appl. No.: 11/225,873

(22) Filed: Sep. 13, 2005

(65) Prior Publication Data

US 2006/0108171 A1 May 25, 2006

(30) Foreign Application Priority Data

Nov. 19, 2004 (JP) ..... 2004-336241
Nov. 19, 2004 (JP) ..... 2004-336242

(51) Int. Cl.
*B62D 33/02* (2006.01)

(52) U.S. Cl. ..... 180/89.13; 180/327; 296/190.01; 296/190.04

(58) Field of Classification Search ..... 180/89.13, 180/327; 296/190.01, 190.04
See application file for complete search history.

(56) References Cited

U.S. PATENT DOCUMENTS 4,771,855 A * 9/1988 Takashima et al. ..... 180/326
4,907,667 A * 3/1990 Yamamoto et al. ..... 180/89.13
6,155,632 A * 12/2000 Fujimoto ..... 296/190.08
6,170,588 B1 * 1/2001 Irino et al. ..... 180/89.1
6,499,556 B1 * 12/2002 Koyama ..... 180/311
6,669,272 B2 * 12/2003 Ayabe et al. ..... 296/190.08
6,922,925 B2 * 8/2005 Watanabe et al. ..... 37/466
7,131,687 B2 * 11/2006 Yokoo et al. ..... 296/190.08
7,320,380 B2 * 1/2008 Ueda et al. ..... 180/327
2003/0110669 A1 * 6/2003 Watanabe et al. ..... 37/466
2006/0226680 A1 * 10/2006 Matsumoto et al. .... 296/190.01
2006/0266573 A1 * 11/2006 Ishii et al. ..... 180/326
2007/0068722 A1 * 3/2007 Miyake ..... 180/327
2007/0132277 A1 * 6/2007 Ishii et al. ..... 296/190.01

FOREIGN PATENT DOCUMENTS

EP 1 457 364 A1 2/2004
JP 2004-268799 3/2003

* cited by examiner

*Primary Examiner*—Faye M. Fleming
*Assistant Examiner*—Barry Gooden, Jr.
(74) *Attorney, Agent, or Firm*—The Webb Law Firm

(57) ABSTRACT

A swivel work machine includes a traveling unit, a swivel base plate supported on the traveling unit to be pivotable about a vertical swivel axis, the swivel base plate having a first lateral side and a second lateral side provided across said vertical axis, a pair of upper and lower support brackets disposed at a front end of the swivel base plate with an offset toward the first lateral side and adapted for supporting an implement, a pair of left and right vertical ribs extending rearward from the support brackets and fixed to the swivel base plate and a cabin mounted on the swivel base plate. The cabin is disposed with an offset toward the second lateral side relative to the support brackets, a bottom of the cabin being disposed downwardly of the upper support bracket. The vertical rib disposed on the side of the second lateral side extends, from its front portion to its intermediate portion, parallel with a side face of the cabin on the side of the first lateral side.

5 Claims, 12 Drawing Sheets

SWIVELING WORK MACHINE

BACKGROUND OF THE INVENTION

1. Field of the Invention

The present invention relates to a swivel work machine such as a backhoe.

In the following description relating to left and right opposed sides of a swivel table or its swivel base plate under a straight traveling condition of a machine body, either one side thereof will be referred to as "one lateral side" or "a first lateral side" and the other side will be referred to as "the other lateral side" or "a second lateral side", respectively.

2. Description of the Related Art

In a conventional backhoe as an example of a swivel work machine, a swivel table is mounted on a traveling unit to be pivotable about a vertical swivel axis. At a front portion of the swivel table, there is mounted a work implement (excavator) having a swing bracket, a boom, an arm, a bucket, etc (see JP-A-2004-268799 or its corresponding EP 1 457 364 A1, for example).

The swivel table includes a swivel base plate which is mounted on a track frame of the traveling unit to be pivotable about a swivel axis via a swivel bearing. To the front of this swivel base plate, there are provided a pair of upper and lower support brackets comprised of plate members. To the front portions of these upper and lower support brackets, a swing bracket is pivotally connected to be pivotable about a vertical axis. Further, to this swing bracket, a base portion of a boom is connected to be pivotable about a right/left axis and a base portion of an arm is connected to the leading end of the boom to be pivotable about a right/left axis. And, at the leading end of this arm, a bucket is connected to be pivotable about a right/left axis.

Further, on the swivel base plate, there are fixedly welded a pair of left and right vertical ribs comprised of plate members extending rearward from the support brackets, with the lower support bracket being fixedly welded to the swivel base plate, front ends of the left and right vertical ribs being inserted between and fixedly welded to the upper and lower support brackets, the portions of the upper and lower support brackets pivotally supporting the swing bracket projecting forwardly from the swivel base plate.

Also, the upper and lower support brackets are disposed with an offset to one lateral side (in this case, to the right side) from the right/left center, and a driver's seat is disposed at a substantially fore-and-aft center position upwardly of the swivel table, with an offset to the other lateral side (in this case, to the left side) from the right/left center. Downwardly of the driver's seat, there is provided a step forming an upper wall of the swivel table. On this step, there is mounted a cabin forming the driver's seat and a driver's cab. The left-side vertical rib and the base portions of the upper and lower support brackets (the rear portions) are disposed under the step to be accommodated within the swivel table.

In the conventional backhoe described above, in order to ensure sufficient strength for supporting the excavator, the front end portions of the left and right vertical ribs to be inserted between the upper and lower support brackets are provided with an extended vertical width. However, as the base portions of the upper and lower support brackets are disposed downwardly of the step, it was difficult to form the bottom of the cabin lower for the purpose of e.g. improved stability.

SUMMARY OF THE INVENTION

In view of the above-described shortcoming of the convention, a primary object of the present invention is to provide a swivel work machine which allows the bottom of the cabin to be formed lower and which can ensure sufficient support strength for supporting the upper and lower support brackets and can also restrict a deformation amount and a stress value of the vertical ribs even when the bottom of the cabin is formed lower.

For accomplishing the above-noted object, the present invention proposes a swivel work machine comprising:

a traveling unit;

a swivel base plate supported on the traveling unit to be pivotable about a vertical swivel axis, said swivel base plate having a first lateral side and a second lateral side provided across said vertical axis;

a pair of upper and lower support brackets disposed at a front end of the swivel base plate with an offset toward said first lateral side and adapted for supporting an implement;

a pair of left and right vertical ribs extending rearward from the support brackets and fixed to the swivel base plate; and a cabin mounted on the swivel base plate;

wherein said cabin is disposed with an offset toward said second lateral side relative to the support brackets, a bottom of the cabin being disposed downwardly of the upper support bracket; and the vertical rib disposed on the side of the second lateral side extends, from its front portion to its intermediate portion, parallel with a side face of the cabin on the side of the first lateral side.

With the above-described construction, as the cabin is disposed on the other right/left side opposite to the support brackets (i.e. disposed with an offset toward said second lateral side relative to the support brackets), the bottom of this cabin can be formed lower and sufficient strength can be ensured for supporting the upper and lower support brackets. Further, as the vertical rib disposed on the side of the second lateral side extends, from its front portion to its intermediate portion, parallel with a side face of the cabin on the side of the first lateral side, the deformation amount and stress value to be experienced in the vertical ribs can be restricted even when the bottom of the cabin is formed low.

In addition to the above-described construction, according to one preferred embodiment of the present invention, said vertical rib extends, at a substantially same height as the upper support bracket, from this support bracket to a position adjacent or rearwardly of said swivel axis. Alternatively, the upper support bracket can be superposed on and fixed to an upper end of said vertical rib, with a portion of the support bracket on the side of the second lateral side extending toward the vicinity of the swivel axis. Further alternatively, the vertical rib is disposed to intersect said swivel axis.

According to another preferred embodiment of the present invention, upwardly of the swivel base plate, there is provided a step mounting a driver's seat thereon, said step being disposed on the side of said second lateral side and downwardly of the upper support bracket. With this construction, as the step is provided on the other side (the second lateral side) of the support bracket, the step can be formed lower and sufficient support strength can be ensured for supporting the upper and lower support brackets. And, as the vertical ribs on the other right/left side extend at substantially same height as the upper support bracket and extend from this support bracket to a position adjacent or rearwardly of the swivel axis and the other side portion of the upper support bracket superposed on and fixed to the upper end of the vertical rib disposed on the other side extends to the vicinity of the swivel axis, the deformation amount and stress value to be experienced in the vertical ribs can be restricted even when the step is formed low.

Further and other features and advantages of the present invention will become apparent upon reading the following detailed description of preferred embodiments thereof with reference to the accompanying drawings.

DESCRIPTION OF PREFERRED EMBODIMENTS

Next, preferred embodiments of the present invention will be respectively described with reference to the accompanying drawings, every embodiment relating to a backhoe as an example of the swivel work machine.

First Embodiment

Figure 1:
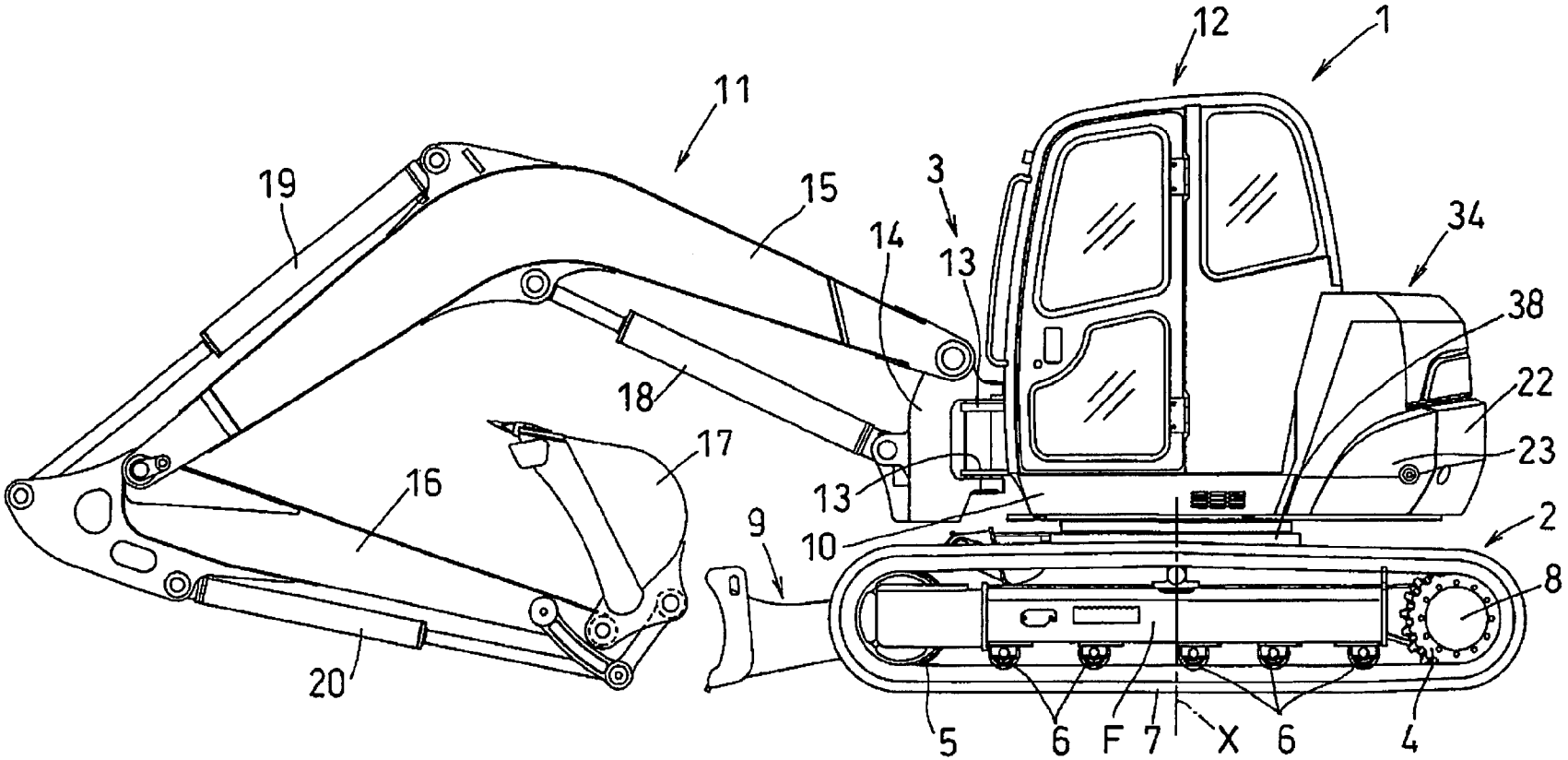
FIG. 1 is a view showing a swivel work machine according to a first embodiment of the present invention, the view being an overall side view showing a backhoe as an example of the swivel work machine.
Figure 2:
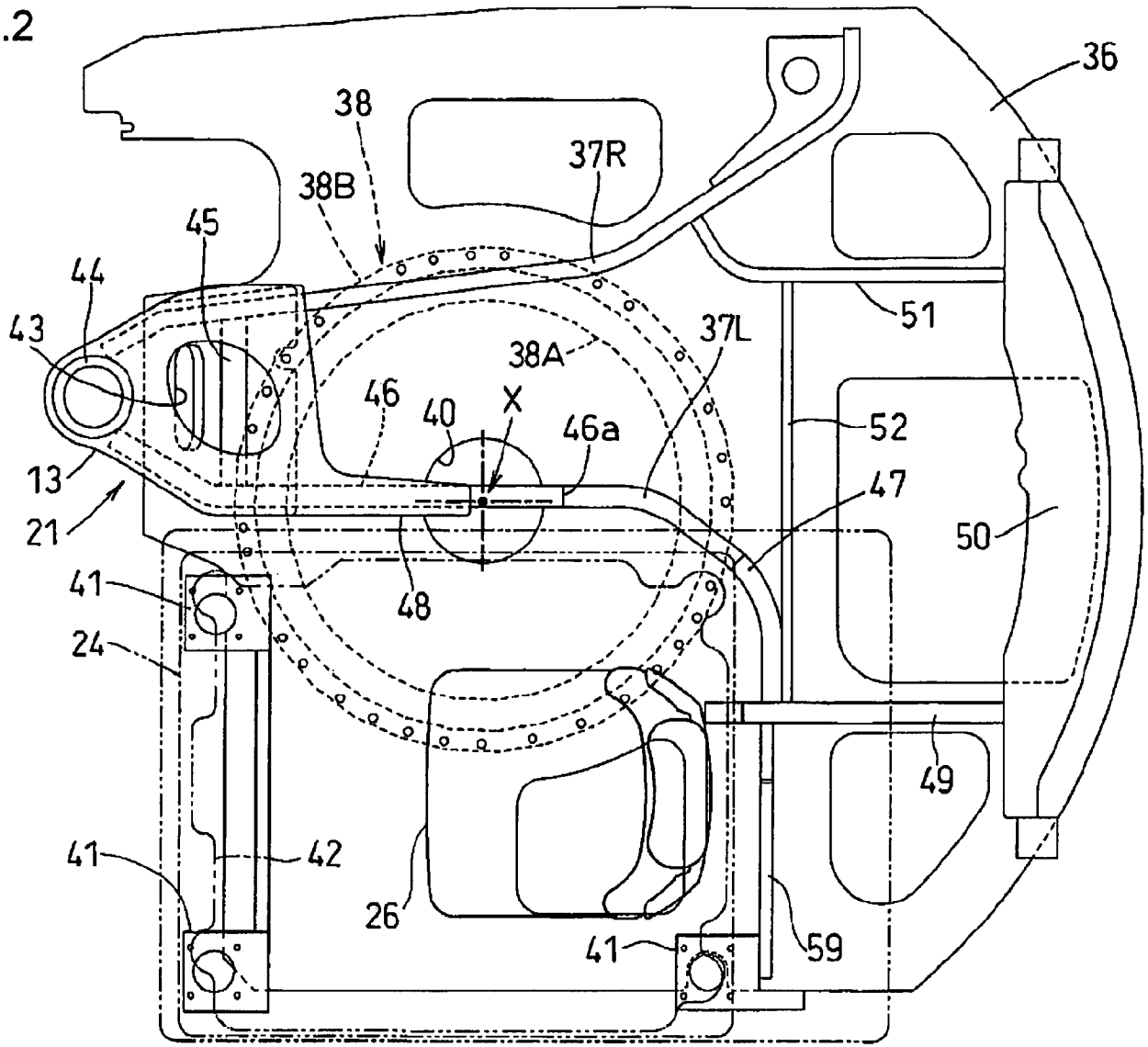
FIG. 2 is a plan view of a swivel frame of the backhoe.
Figure 3:
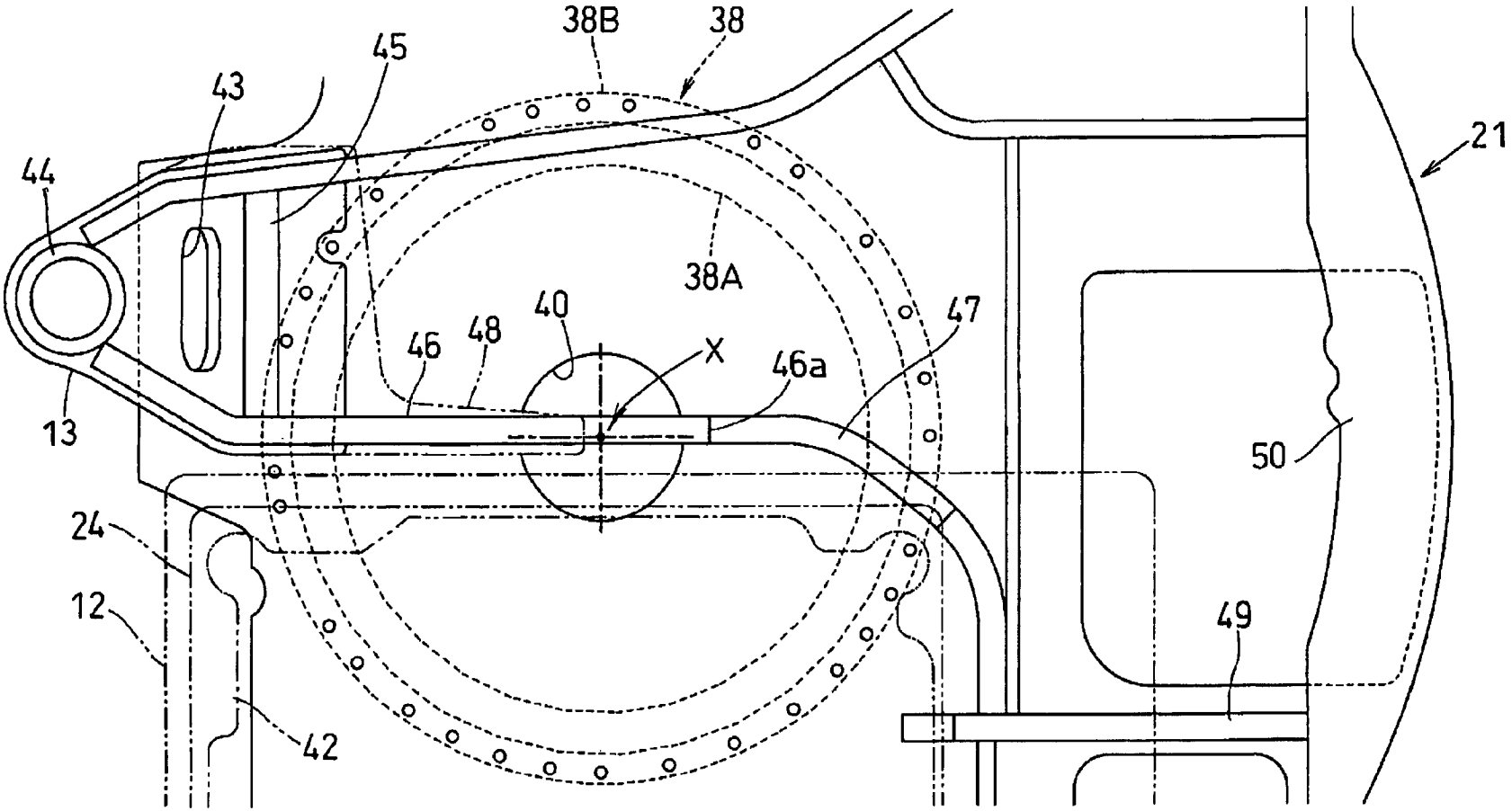
FIG. 3 is an enlarged plan view of principal portions of the swivel frame.
Figure 4:
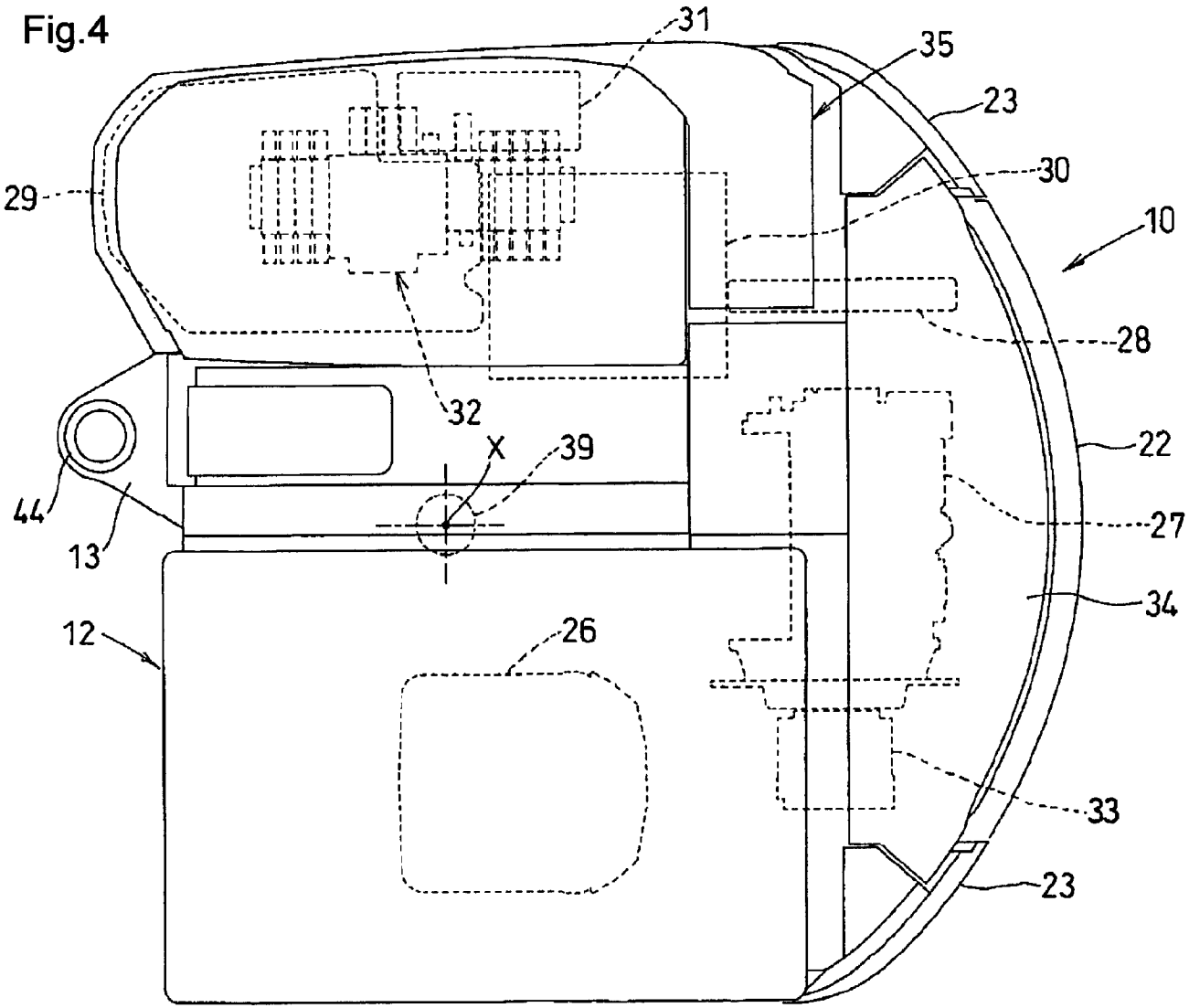
FIG. 4 is a plan view of a swivel table of the backhoe.
Figure 5:
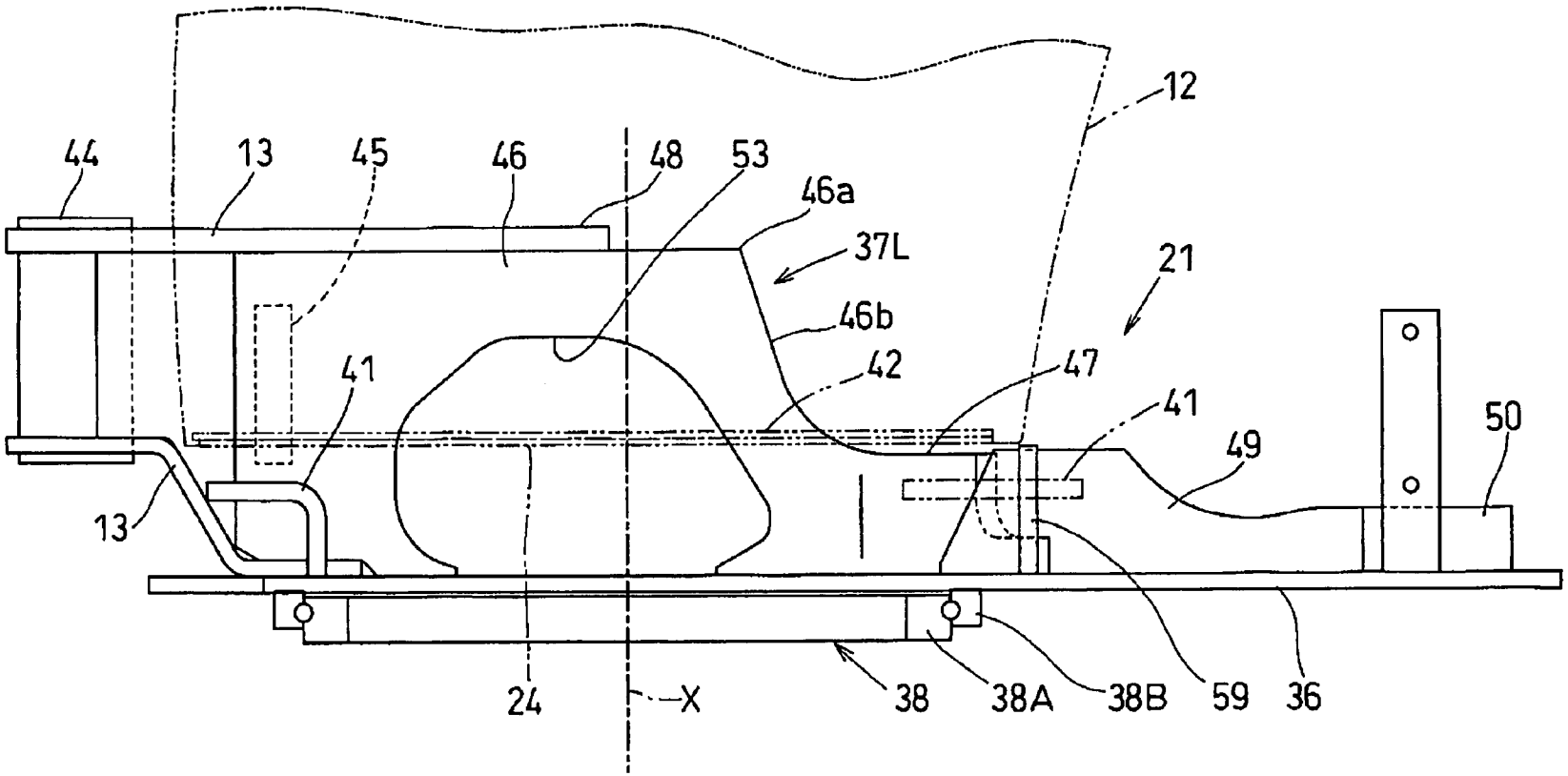
FIG. 5 is a left side view of the swivel frame.
Figure 6:
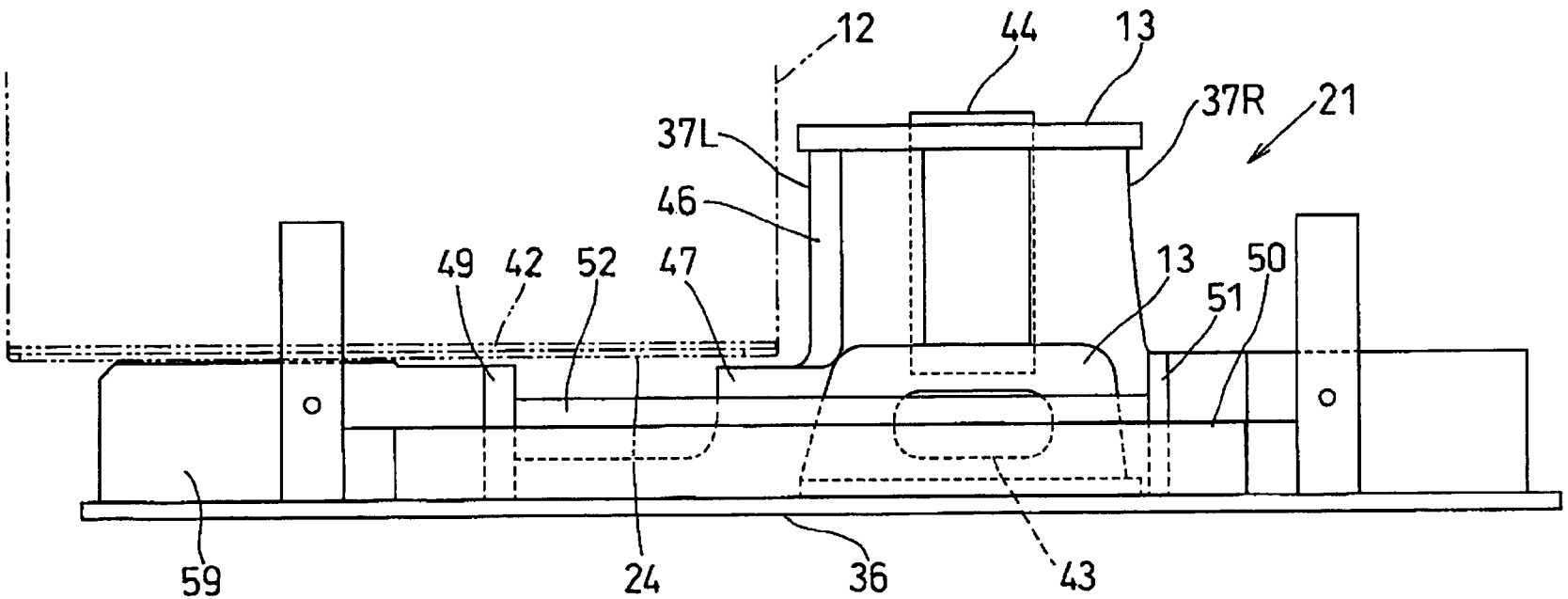
FIG. 6 is a rear view of the swivel frame.
Figure 7:
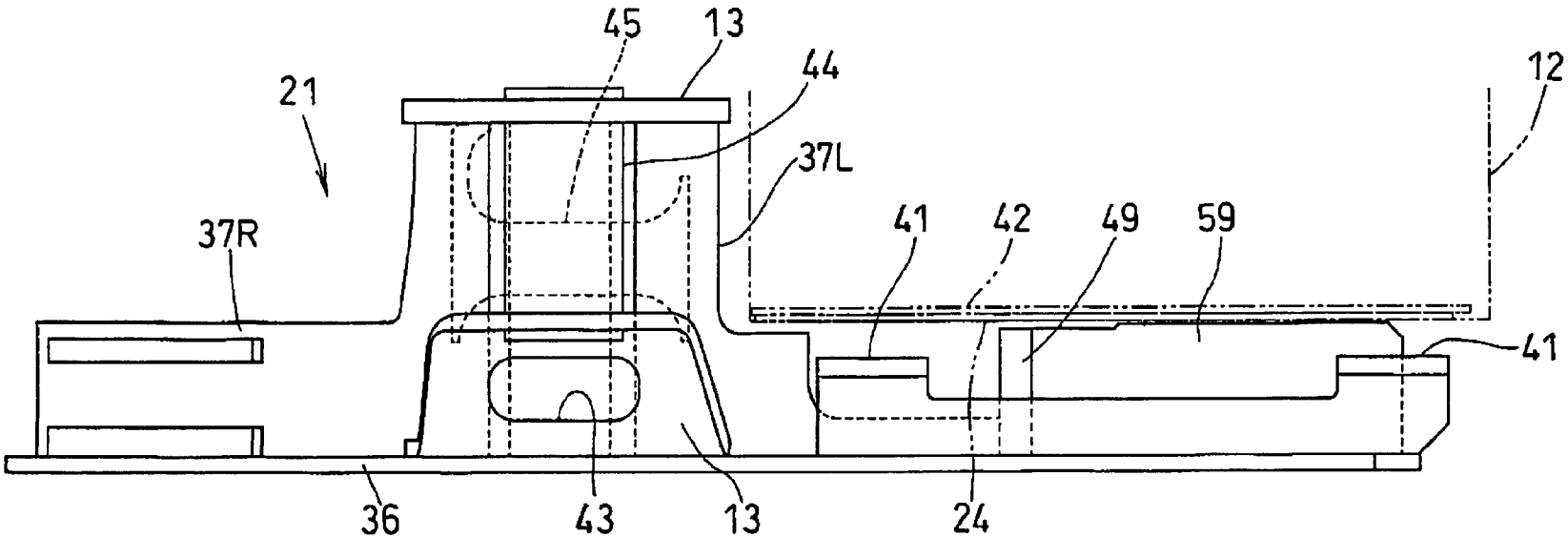
FIG. 7 is a front view of the swivel frame.
Figure 8:
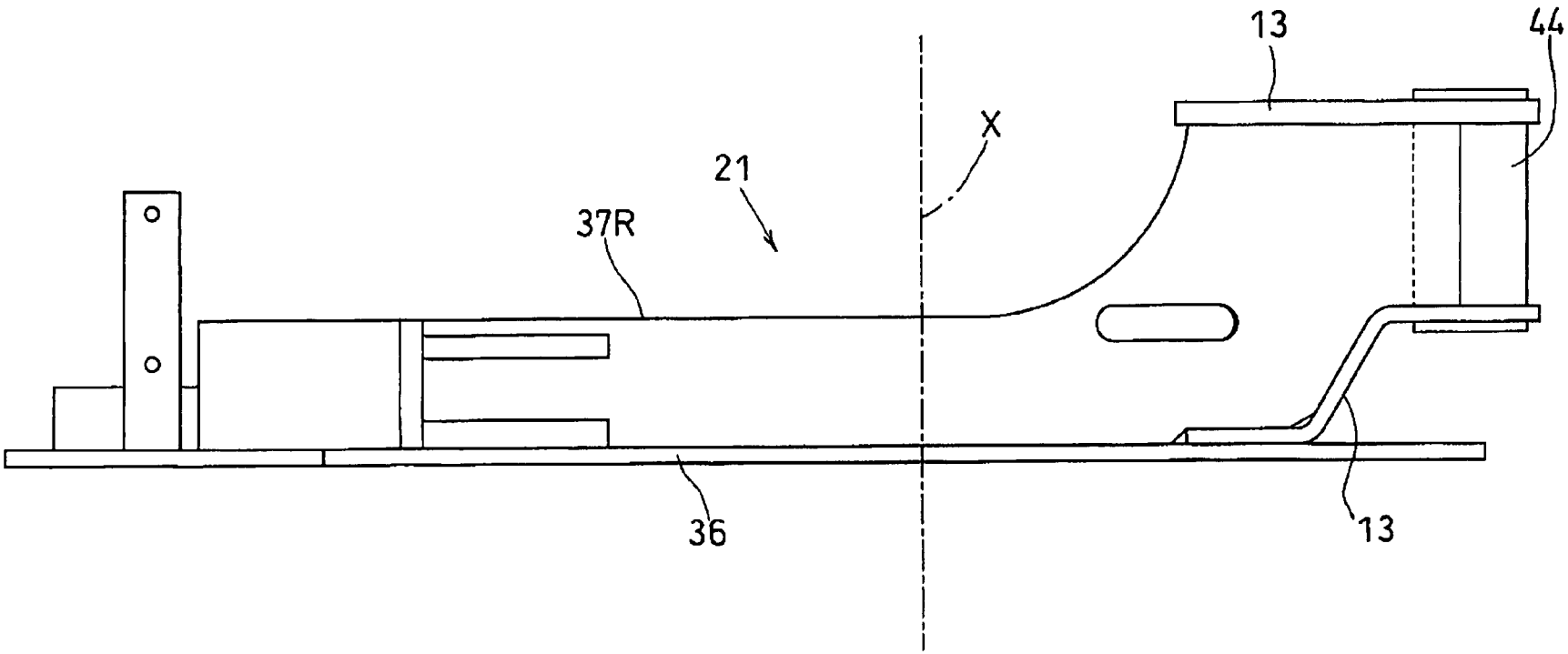
FIG. 8 is a right side view of the swivel frame.

A backhoe 1 shown in FIG. 1 consists mainly of a pair of traveling units 2 disposed at a lower portion of the backhoe and a swivel body 3 disposed at an upper portion of the same.

Each traveling unit 2 comprises a crawler type traveling unit including a sprocket 4, an idler 5, roller wheels 6 and a crawler belt 7 entrained about these members. As the sprocket 4 is rotatably driven by a hydraulic motor 8, the crawler belt 7 is driven endlessly in circulation for propelling the backhoe.

At the front portions of the traveling units 2, there is provided a dozer 9.

The swivel body 3 includes a swivel table 10 mounted on the traveling units 2 to be pivotable about a vertical swivel axis X and an implement (an excavator) 11 attached to a front portion of the swivel table 10. Further, the swivel table 10 mounts thereon a cabin 12 forming a driver's cab.

To the front portion of the swivel table 10, there are attached a pair of upper and lower support brackets 13 comprised of plate members for supporting the implement 11.

The implement 11 includes a swing bracket 14 supported to the upper and lower support brackets 13 to be pivotable to the right or left about a vertical axis, a boom 15 having its base portion pivotally connected to the swing bracket 14 to be vertically pivotable about a right/left axis, an arm 16 pivotally connected to a leading end of the boom 15 to be pivotable in the fore and aft direction about a right/left axis, and a bucket 17 pivotally connected to the leading end of the arm 16 to be pivotable about a right/left axis.

The swing bracket 14 is pivoted in association with an expansion/contraction of a swing cylinder which is disposed on the right side within the horizontal extension of the swivel table 10. The boom 15 is pivoted in association with an expansion/contraction of a boom cylinder 18 interposed between this boom 15 and the swing bracket 14. The arm 16 is pivoted in association with an expansion/contraction of an arm cylinder 19 interposed between this arm 16 and the boom 15. The bucket 17 is pivoted in association with an expansion/contraction of a bucket cylinder 20 interposed between this bucket 17 and the arm 16. The swing cylinder, the boom cylinder 18, the arm cylinder 19 and the bucket cylinder 20 all comprise hydraulic cylinders.

As shown in FIGS. 1 through 8, the swivel table 10 includes a swivel frame 21 acting a framework for this table, a counter weight 22 fixedly attached to a rear portion of the swivel frame 21 for providing weight balance relative to the implement 11 disposed forwardly and constituting a rear portion of the swivel table 10, and a pair of side protectors 23 provided on the opposed left and right sides of the counter weight 22 and constituting the rear portion of the swivel table 10 together with the counter weight 22. Right and left sides and front side of the swivel frame 21 are covered with a cover member, and the left side of the front portion of the swivel frame 21 is covered with a step 24 comprised of a plate member and constituting the upper wall of the swivel table 10.

The swivel frame 21 mounts thereon, various components such as a driver's seat 26, an engine 27, a radiator 28, a fuel tank 29, a work oil tank 30, a battery 31, a control valve unit 32, etc. The driver's seat 26 is disposed at substantially fore-and-aft center and with an offset to the left side from the right/left center. The engine 27 is disposed at a rear portion of the swivel table 21 with a lateral orientation with an axis of its crank shaft being aligned with the right/left direction. The radiator 28 is disposed on the right side of the engine 27. On the left side of the engine 27, there is provided a hydraulic pump 33. The fuel tank 29, the work oil tank 30, the battery 31 and the control valve unit 32 are disposed on the right side of the swivel table 21 and forwardly of the radiator 28.

Further, the disposing portions for the engine 27 and the radiator 28 are covered with a hood 34, and disposing portions for the fuel tank 29, the work oil tank 30, the battery 31 and the control value 32 are covered with a tank cover 35.

The control value 32 comprises an assembly of control values connected together in the fore and aft direction for controlling the various hydraulic components included in the backhoe 1.

The swivel frame 21 includes a swivel base plate 36 comprised of a plate member constituting a bottom wall of the swivel table 10, a pair of vertical ribs 37L, 37R comprised of a pair of left and right plate members fixedly welded to the swivel base plate 36, and the upper and lower support brackets 13 fixed to the front ends of these vertical ribs 37L, 37R.

The swivel base plate 36 is supported to a track frame F of the traveling units 2 via a swivel bearing 38 to be pivotable about a vertical swivel axis (vertical axis) X. This swivel base plate 36 includes, across the vertical axis, a first lateral side (the upper edge lateral side in FIG. 2) and a second lateral side (the lower edge lateral side in FIG. 2). An inner race 38A of the swivel bearing 38 is bolt-fixed to the track frame F while its outer race 38B is bolt-fixed to the lower face of the swivel base plate 36.

At the swivel center of the swivel base plate 36, there is formed a circular insertion hole 40 for allowing insertion of an upper portion of a swivel joint 39 for feeding pressure oil from the control valve unit 32 of the swivel table 10 to the hydraulic components of the traveling units 2.

The upper and lower support brackets 13 are disposed with an offset toward the right side from the right/left center of the front portion of the swivel base plate 36. The step 24 and the cabin 12 are disposed on the left side of the upper and lower support brackets 13. That is, the upper and lower support brackets are disposed at a front end of the swivel base plate 36 with an offset toward the first lateral side and adapted for supporting an implement 11. And, the cabin 12, the step 24 as well, is disposed with an offset toward the second lateral side relative to the support brackets 13.

On the swivel base plate 36, there are fixed support stays 41 for supporting the step 24, and the step 24 is supported to these support stays 41 via vibration isolating rubber (mount rubber).

Also, the cabin 12 has its lower end open and is mounted on the step 24 in such a manner that the lower end opening is closed by the step 24. Further, as an attaching wall 42 provided at a lower opening edge of the cabin 12 is bolt-fixed to the step 24, the cabin 12 is detachably attached to the step 24.

A vertical intermediate portion of a rear portion of the cabin 12 is supported via vibration isolating rubber to a support member mounted erect on the swivel base plate 36 for supporting the hood 34, etc.

The base portion (rear portion) of the lower support bracket 13 is superposed on the swivel base plate 36 and fixedly welded to this swivel base plate 36. A fore-and-aft intermediate portion of this lower support bracket 13 is formed with an inclination so that the portion extends upward as extending from the front end of the base portion of this lower support bracket 13. The leading end (front portion) of this lower support bracket 13 projects forwardly from the front end of the intermediate portion thereof.

Incidentally, the inclined portion of the lower support bracket 13 defines a through hole 43 for allowing insertion of a hydraulic hose for feeding pressure oil to the respective hydraulic cylinders of the implement 11.

The upper support bracket 13 is formed like a flat plate and is disposed with a vertical gap relative to the lower support bracket 13.

The front portions of these upper and lower support brackets 13 project forwardly from the swivel base plate 36. And, at the front portions of the upper and lower support brackets 13, there is fixed a cylindrical shaft 44 having a vertical axis and extending between the front portions of the upper and lower support brackets 13. And, via a pivot shaft inserted into this cylindrical shaft 44, the swing bracket 14 is pivotally supported to the upper and lower support brackets 13.

The step 24 and the bottom of the cabin 12 are disposed at positions (lower positions) lower than the upper support bracket 13.

The left and right vertical ribs 37L, 37R are disposed with a vertical orientation such that their plate thickness direction extends normal to the vertical direction (that is, their plate width direction is aligned with the vertical direction). The front ends of these left and right vertical ribs 37L, 37R are inserted between the upper and lower support brackets 13 and the upper ends of these inserted portions are contacted against and fixedly welded to the lower face of the upper support bracket 13. Whereas, the lower ends of the inserted portions are contacted against and fixedly welded to the upper face of the lower support bracket 13. The front ends of the respective vertical ribs 37L, 37R are fixedly welded to the cylindrical shaft 44.

Further, the portions of the left and right vertical ribs 37L, 37R inserted between the upper and lower support brackets 13 are connected to each other via an interconnecting member 45.

Moreover, the portions of the left and right vertical ribs 37L, 37R which portions extend rearward from the lower support bracket 13 are placed in contact against and fixedly welded to the upper face of the swivel base plate 36.

The right vertical rib 37R extends rearward from the right side between the upper and lower support brackets 13, whereas the left vertical rib 37L extends rearward from the left side of the upper and lower support brackets 13.

Referring to the right vertical rib 37R in greater details, its intermediate portion extends upwardly of the right side of the swivel bearing 38, its rear portion is formed with an inclination such that the portion extends outward in the right/left direction as extending rearward and its rear end is bent toward the outer side in the right/left direction.

On the other hand, the left vertical rib 37L is disposed in such a manner that this rib intersects the swivel bearing 38 at two fore-and-aft positions as seen in a plan view.

Referring to the height of this left vertical rib 37L, at a front portion through an intermediate portion thereof, the rib extends rearward at a substantially same height as the upper support bracket 13 (or the position of its lower face) and at the rear portion, the rib is formed lower than the step 24. Therefore, the vertical width of the left vertical rib 37L is increased from the front portion through the intermediate portion and is decreased at the rear portion.

The wide (increased vertical width) portion 46 of the left vertical rib 37L is formed with an inclination such that the front end portion, relative to the intermediate portion and the rear portion, is formed narrower in correspondence with the gap or distance between the upper and lower support brackets 13 and the front portion extends inward in the right/left direction. The intermediate portion to the rear end of the wide portion 46 has a substantially constant vertical width and is disposed in such a manner as to intersect the swivel axis X straight in the fore and aft direction (traverses the center of the insertion hole 40 in the fore and aft direction in the plan view) and in parallel with the right side (outer face on the inner side of the right/left direction) of the cabin 12.

Further, a rear edge 46*a* of an upper end of the wide portion 46 of the left vertical rib 37L is located rearwardly of the swivel axis X (Instead, the wide portion 46 can extend such that its upper end rear edge 46*a* is located adjacent the swivel axis X).

Further, a rear face 46*b* of this wide portion 46 is formed as a sharply inclined face extending upward toward the rear side thereof.

The narrow (decreased vertical width) portion 47 formed at the rear portion of the left vertical rib 37L is formed straight in the fore and aft direction at a front portion thereof and an intermediate portion is bent with an inclination such that the portion extends outward in the right/left direction as extending rearward. Further, a mid portion of this intermediate portion has a decreased height (vertically narrower) and a rear portion extends outward in the right/left direction.

Further, at the left portion of the upper support bracket 13 superposed on and fixedly welded to the upper ends of the left and right vertical ribs 37L, 37R, there is provided an extension portion 48 extending rearward to the vicinity of the swivel axis X.

On the lateral outer side of the rear end of the left vertical rib 37L, there is provided a reinforcing plate 49 disposed with a vertical orientation and along the fore and aft direction and fixedly welded to the swivel base plate 36. And, to the lateral inner sides of this reinforcing plate 49, end portions of the longitudinal rear portions of the left and right vertical ribs 37L, 37R are connected.

The rear end of this reinforcing plate 49 is connected to a reinforcing block 50 provided at the right/left center at the rear end of the swivel base plate 36.

Further, the right/left inner side of the rear portion of the right vertical rib 37R and the front right side of the reinforcing block 50 are connected via a reinforcing plate 51 and this reinforcing plate 51 and the reinforcing plate 49 are interconnected via the interconnecting plate 52.

Further, at the front and left side of the reinforcing plate 49, there is provided a reinforcing plate 59 along the right/left direction, with this reinforcing plate 59 being connected to the reinforcing plate 49.

Also, at the front portion (increased vertical width portion) of the left vertical rib 37L, there is formed an insertion hole 53 for allowing insertion of a hydraulic hose which connects a pilot control valve provided on the left side of the left vertical rib 37L with a pilot switchover valve for the control valve unit 32 provided on the right side of the right vertical rib 37R.

This insertion hole 53 is formed at a position corresponding to the insertion hole 40 formed at the swivel center of the swivel base plate 36 and is formed in such a manner as to prevent the left vertical rib 37L from interfering with the swivel joint 39 and also to allow connection of the hydraulic hose to the swivel joint 39.

Incidentally, the respective hydraulic hoses described above extend upwardly of the right vertical rib 37R to be connected to the control valve unit 32.

With the back hoe 1 according to this embodiment, since the step 24 and the cabin 12 are disposed on the left side of the upper and lower support brackets 13 supporting the implement 11, the step 24 and the bottom of the cabin 12 can be formed low. Or, there can be ensured a greater vertical distance between the upper and lower support brackets 13 (the vertical width of the front ends of the right and left vertical ribs 37L, 37R), without raising the position of the step 24, for example.

Further, the left vertical rib 37L extends, at its font portion through its intermediate portion, parallel with the outer side of the right side of the cabin 12, from the support brackets 13 to the position rearwardly of the swivel axis X. Hence, during an excavating operation with swinging the swing bracket 14 for orienting the boom 15 obliquely right forward side, the stress applied to a portion having the sharp height change of the left vertical rib 37L of the swivel frame 2 (such as a portion 61 as shown in FIG. 12) can be effectively dispersed, so that the deformation amount and the stress value experienced by the left vertical rib 37L due to the load from the implement 11 can be restricted effectively.

Moreover, because the left portion of the upper support bracket 13 superposed on and fixed to the upper ends of the left and right vertical rib 37L, 37R extends to the vicinity of the swivel axis X, the stress can be dispersed even more effectively, and the deformation amount and stress value of the left vertical rib 37L can be restricted even more effectively.

Figure 12:
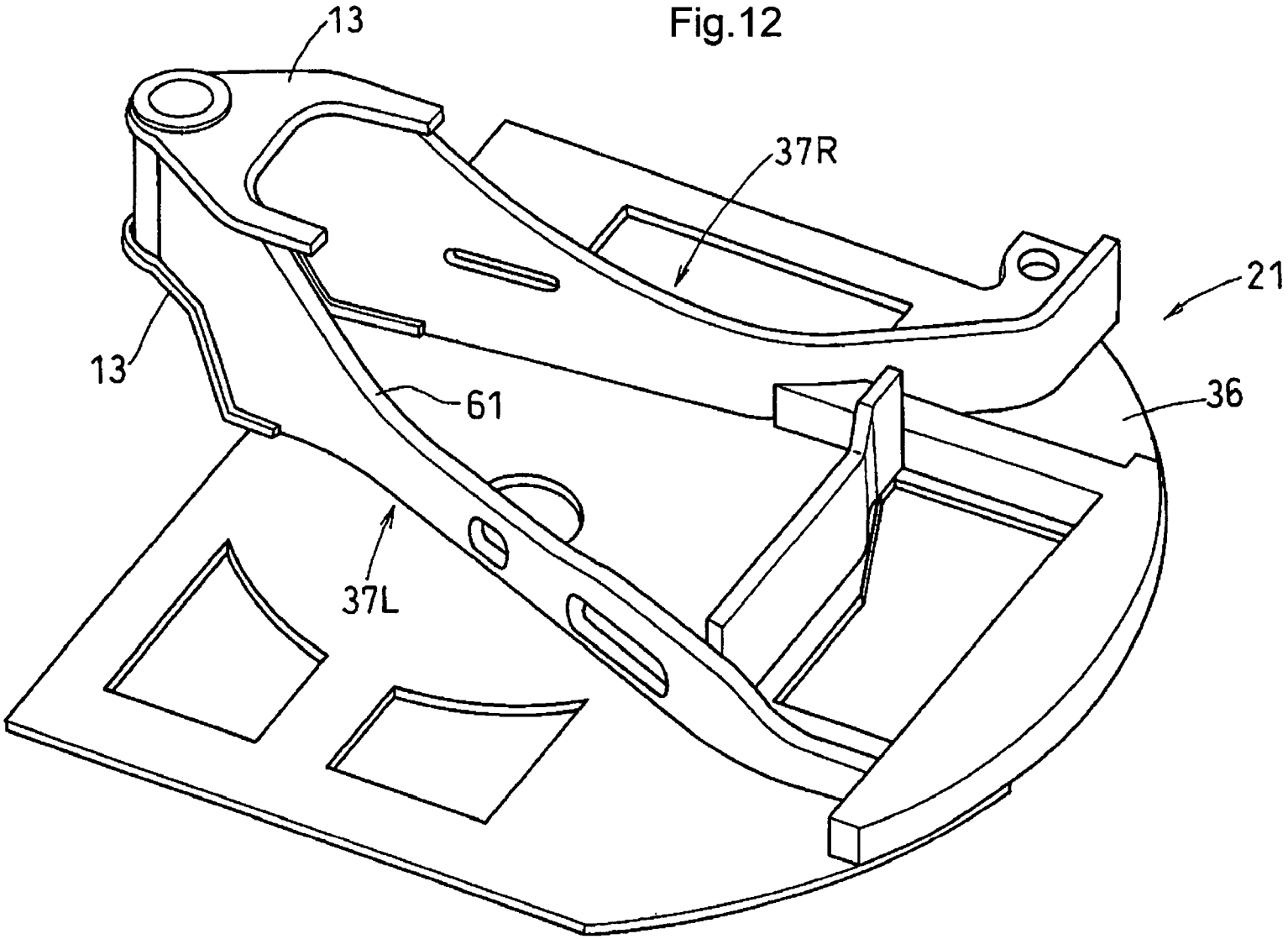
FIG. 12 is a perspective view showing a swivel frame of a swivel work machine (backhoe) according to a comparison example.

Incidentally, FIG. 12 is a perspective view of a swivel frame in a swivel work machine (backhoe) relating to a comparison example. In order to form a cabin bottom low while ensuring supporting strength for the excavator, as illustrated in this figure, it is to conceivable to dispose the cabin and the step with an offset toward the left side of the upper and lower support brackets.

However, for the purpose of e.g. ensuring strength for the swivel base plate, effectively dispersing a load applied from the excavator, the left-side vertical rib extends obliquely toward the left side as extending rearwardly from the upper and lower support brackets and its intermediate portion through its rear portion is disposed downwardly of the step. For this reason, if the cabin is disposed on the left side of the upper and lower support brackets to be lower than the upper support bracket, then, as illustrated in FIG. 12, it becomes necessary for the height of the left-side vertical rib 27L to be reduced sharply in the middle of its extension from its front end to its intermediate portion. This will result in a significant amount of deformation (flexion) in the left-side vertical rib 37L. As a result, during an excavating operation, when the bucket is operated toward the machine body to scoop an amount of earth and e.g. the boom is pivoted and then stopped, there will occur a significant reactionary displacement which tends to result in inadvertent drop of the scooped earth off the bucket.

Further, during an excavating operation with swinging the swing bracket for orienting the boom toward a right oblique forward side, there will occur stress concentration at the above-described portion 61 of the left vertical rib where the height sharply changes, so that the value of the stress affecting this portion 61 will be high.

Incidentally, in FIG. 12, the other components having substantially same functions as those in the foregoing embodiment are denoted with like reference numerals and description thereof will be omitted.

Second Embodiment

Figure 9:
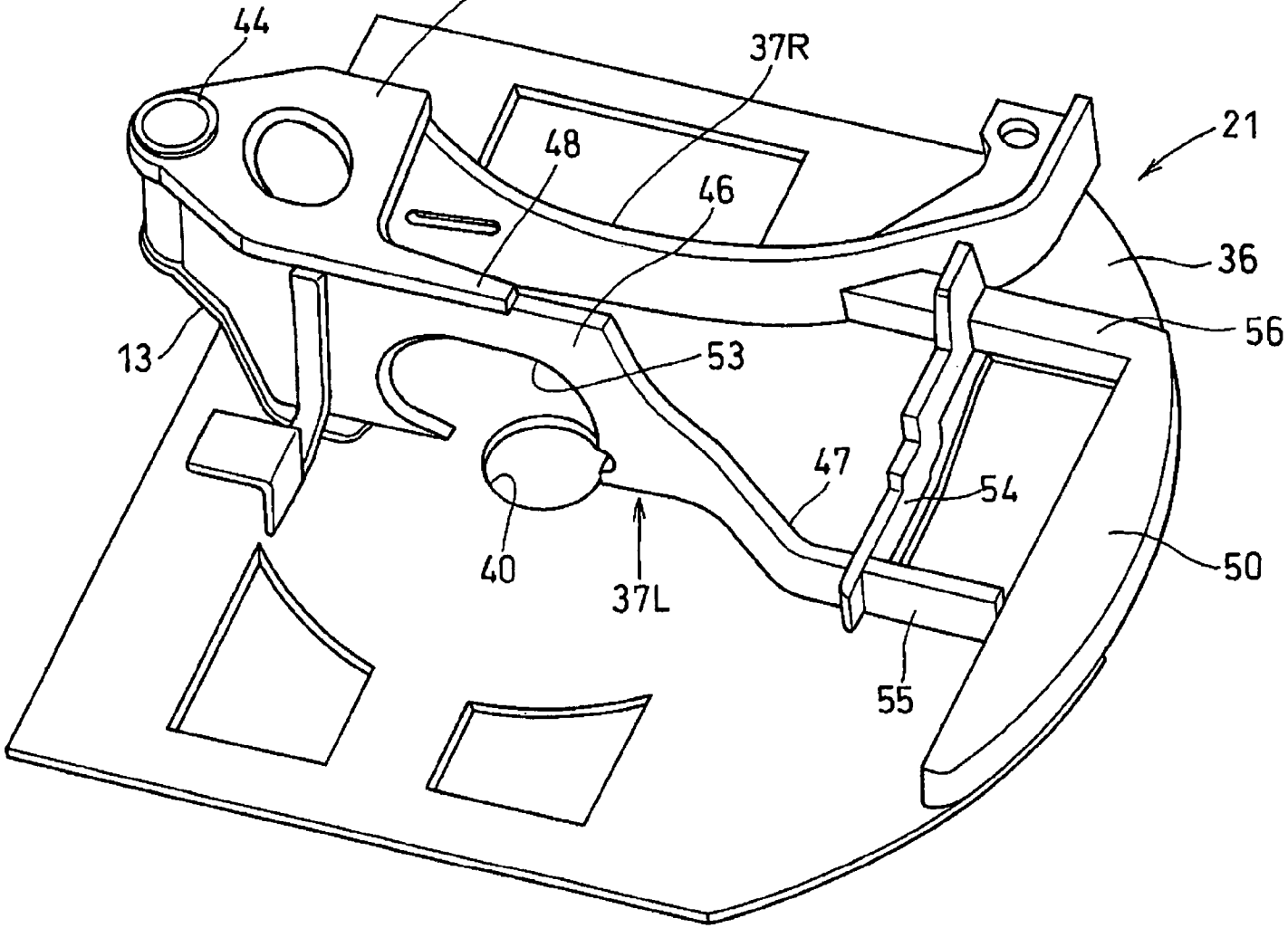
FIG. 9 is a perspective view showing a swivel frame of a swivel work machine (backhoe) according to a second embodiment of the present invention.
Figure 10:
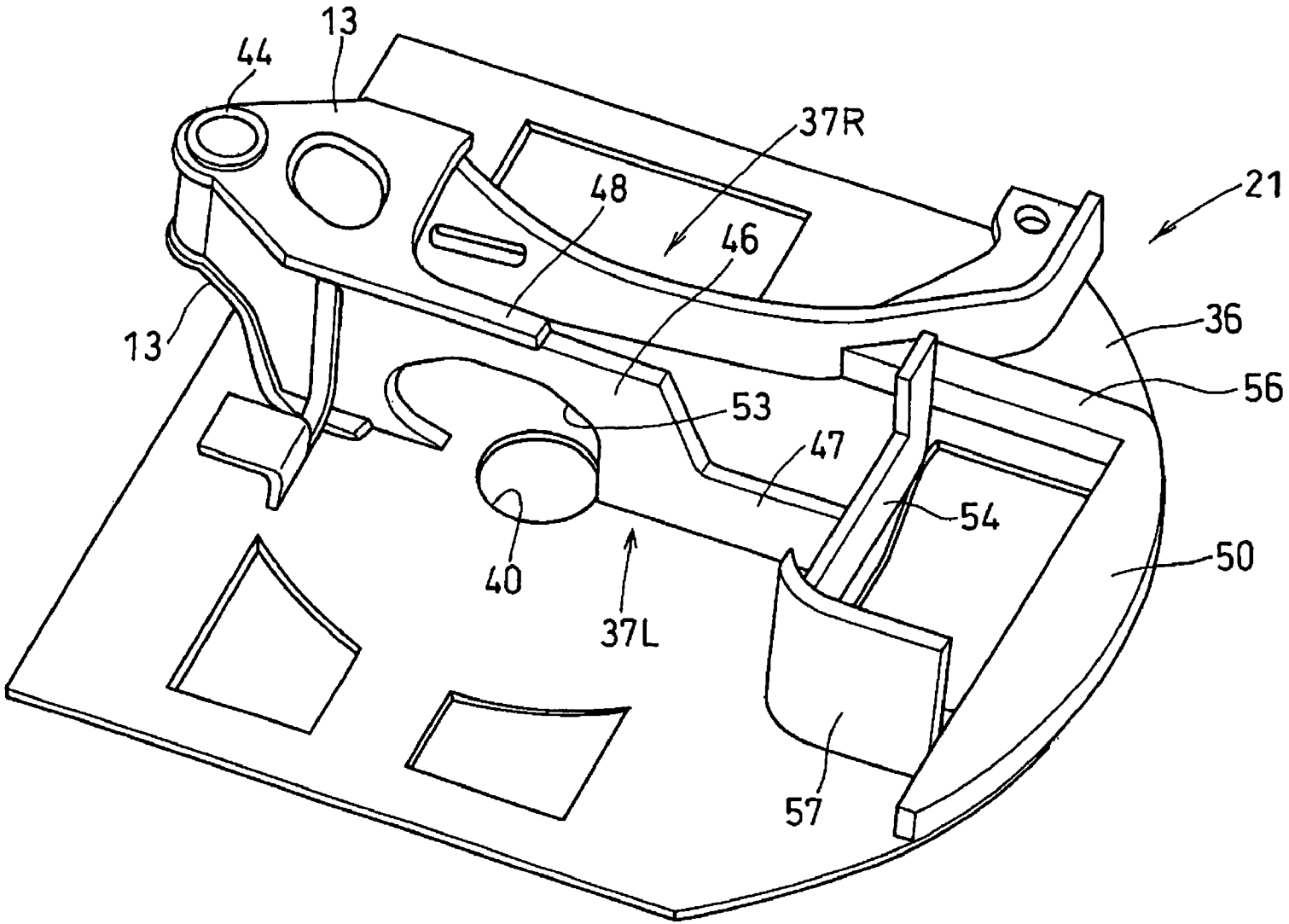
FIG. 10 is a perspective view showing a swivel frame of a swivel work machine (backhoe) according to a third embodiment of the present invention.
Figure 11:
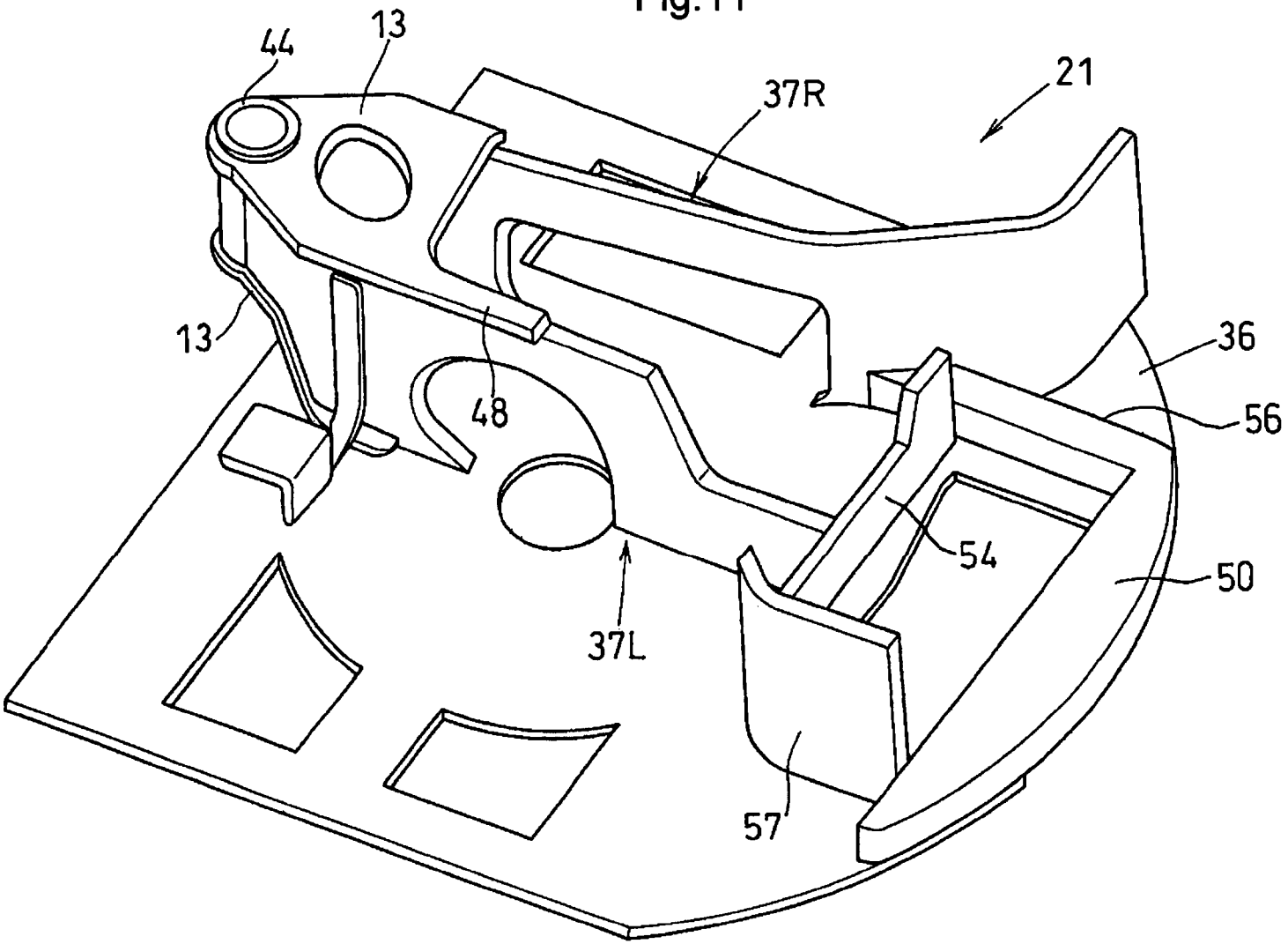
FIG. 11 is a perspective view showing a swivel frame of a swivel work machine (backhoe) according to a fourth embodiment of the present invention.

FIGS. 9 through 11 show further embodiments. In the case of the second embodiment shown in FIG. 9, the rear portion of the narrow portion 47 of the rear portion of the left vertical rib 37L is formed straight in the fore and aft direction to be connected to the reinforcing plate 54 disposed along the right/left direction. And, this reinforcing plate 54 is connected to the reinforcing block 50 via the reinforcing plate 55. Further, on the right side of the reinforcing block 50, there is provided an extension portion 56 which projects forwardly to be connected to the right vertical rib 37R, with the reinforcing plate 54 being connected to this extension portion 56.

Incidentally, the left vertical rib 37L and the reinforcing plate 55 can be formed integral.

The rest of the construction is substantially identical to that of the first embodiment shown in FIGS. 1 through 8.

Third Embodiment

In the case of the third embodiment shown in FIG. 10, the narrow portion 47 of the rear portion of the left vertical rib 37L is formed straight to extend rearward from the wide portion 46 provided forwardly thereof, to be connected to the reinforcing plate 54 disposed along the right/left direction. The left end of this reinforcing plate 54 is connected to a reinforcing plate 57 which is disposed along the fore and aft direction and whose rear end is connected to the reinforcing block. Whereas, the right end of the reinforcing plate 54 is connected to the extension portion 56 provided on the right side of the reinforcing block 50.

The rest of the construction is substantially identical to that of the foregoing embodiments.

Fourth Embodiment

In the case of the fourth embodiment shown in FIG. 11, there is provided a modification added to the swivel frame 21 shown in FIG. 10. The differences from the construction of the swivel frame 10 shown in FIG. 10 are that the height of the right vertical rib 37R is increased (the vertical width is increased) and also this right vertical rib 37R defines an insertion hole 58 for allowing insertion of the hydraulic hose.

The rest of the construction is substantially identical to that of the foregoing embodiments.

The invention claimed is:

1. A swivel work machine comprising:

a traveling unit;

a swivel base plate supported on the traveling unit to be pivotable about a vertical swivel axis, said swivel base plate having a first lateral side and a second lateral side provided across said vertical swivel axis;

a pair of upper and lower support brackets facing to each other in a vertical direction and disposed with an offset toward said first lateral side, said support brackets being adapted for supporting an implement so that said implement is pivotable to the right or left about a vertical axis;

a pair of left and right vertical ribs extending rearward from the support brackets and fixed to the swivel base plate; and a cabin mounted on the swivel base plate;

wherein said cabin is disposed with an offset toward said second lateral side relative to the support brackets and disposed rearwardly of front ends of the respective support brackets, a bottom of the cabin being disposed downwardly of the upper support bracket, and disposed downwardly of an upper end of one vertical rib disposed closer to the second lateral side in a region extending from a front portion through an intermediate portion of the one vertical rib; and said region of the one vertical rib extends parallel with a side face of the cabin disposed closer to the first lateral side.

2. The swivel work machine according to claim 1, wherein said one vertical rib extends, at a substantially same height as the upper support bracket, from this support bracket to a position adjacent or rearwardly of said swivel axis.

3. The swivel work machine according to claim 1, wherein the upper support bracket is superposed on and fixed to an upper end of said one vertical rib, with a portion of the support bracket on the side of the second lateral side extending toward the vicinity of the swivel axis.

4. The swivel work machine according to claim 1, wherein said one vertical rib is disposed to intersect said swivel axis.

5. The swivel work machine according to claim 1, wherein upwardly of the swivel base plate, there is provided a step mounting a driver's seat thereon, said step being disposed on the side of said second lateral side and downwardly of the upper support bracket.

* * * * *